US010556155B2

(12) United States Patent
Nelson

(10) Patent No.: US 10,556,155 B2
(45) Date of Patent: Feb. 11, 2020

(54) TENNIS BALL PICKUP TUBE ATTACHMENT BAG

(71) Applicant: Matthew Nelson, Alpharetta, GA (US)

(72) Inventor: Matthew Nelson, Alpharetta, GA (US)

( * ) Notice: Subject to any disclaimer, the term of this patent is extended or adjusted under 35 U.S.C. 154(b) by 0 days.

(21) Appl. No.: 16/359,944

(22) Filed: Mar. 20, 2019

(65) Prior Publication Data

US 2019/0308077 A1 Oct. 10, 2019

Related U.S. Application Data

(60) Provisional application No. 62/633,384, filed on Feb. 21, 2018.

(51) Int. Cl.
*A63B 47/02* (2006.01)
*A63B 47/00* (2006.01)
*A63B 102/02* (2015.01)

(52) U.S. Cl.
CPC ..... *A63B 47/02* (2013.01); *A63B 47/001* (2013.01); *A63B 2102/02* (2015.10)

(58) Field of Classification Search
CPC ..... A63B 47/02
USPC ..... 294/19.2
See application file for complete search history.

(56) References Cited

U.S. PATENT DOCUMENTS 2,203,170 A * 6/1940 MacDonald ..... A63B 47/02 294/19.2
4,063,769 A * 12/1977 Zimmer ..... A63B 47/02 294/19.2
4,088,251 A * 5/1978 Rodriguez ..... A45C 11/00 224/626
4,626,235 A * 12/1986 Kesselring ..... B31B 70/00 264/294
5,026,061 A * 6/1991 Davis ..... A63B 47/02 473/173
5,396,146 A * 3/1995 Nakamura ..... C21D 8/0205 313/402

(Continued)

*Primary Examiner* — Paul T Chin
(74) *Attorney, Agent, or Firm* — Charlena Thorpe, Esq.; Incorporating Innovation LLC

(57) ABSTRACT

Implementations of a tennis ball pickup tube attachment bag are provided. In some implementations, the tennis ball pickup tube attachment bag comprises one or more pieces of material attached together and forming an enclosed interior and a corresponding exterior. In some implementations, the tennis ball pickup tube attachment bag also comprises a first opening and a second opening into the enclosed interior. In some implementations, the tennis ball pickup tube attachment bag also comprises a first securing loop and a second securing loop. In some implementations, the tennis ball pickup tube attachment bag also comprises a first securing strap, a second securing strap, and a third securing strap.

In some implementations, a method for using the tennis ball pickup tube attachment bag comprises coupling the tennis ball pickup tube to the tennis ball pickup tube attachment bag, attaching the first securing loop and the second securing loop respectively to the first retainer wing and the second retainer wing of the tennis ball pickup tube, attaching the first securing strap to the carry strap loop of the tennis ball pickup tube, and attaching the second securing strap and the third securing strap respectively across the length of the tennis ball pickup tube.

15 Claims, 5 Drawing Sheets

(56) References Cited

U.S. PATENT DOCUMENTS

| | | | | | |
|---|---|---|---|---|---|
| 5,476,297 | A * | 12/1995 | Lombard | A63B 47/02 | 294/19.2 |
| 5,988,716 | A * | 11/1999 | Liao | A63B 47/02 | 294/19.2 |
| 6,050,625 | A * | 4/2000 | Nisbet | A63B 47/02 | 221/281 |
| D478,139 | S * | 8/2003 | Imig | D21/721 | |
| 6,604,767 | B1 * | 8/2003 | Daniels | A63B 47/02 | 294/19.2 |
| 8,657,351 | B2 * | 2/2014 | Johnson | A63F 9/0001 | 135/74 |

* cited by examiner

TENNIS BALL PICKUP TUBE ATTACHMENT BAG

CROSS REFERENCE TO RELATED APPLICATION

This application claims the benefit of U.S. Patent Application Ser. No. 62/633,384, which was filed on Feb. 21, 2018, and is incorporated herein by reference in its entirety.

TECHNICAL FIELD

This disclosure relates to implementations of a tennis ball pickup tube attachment bag.

BACKGROUND

FIG. 1 illustrates an example existing tennis ball pickup tube used to collect tennis balls on a tennis court. However, existing tennis ball pickup tubes can only collect a limited number of balls, and must be emptied repeatedly to collect additional balls. To empty an existing tennis ball pickup tube, a user must dump the tennis balls into a receptacle which is usually some distance away from the current location of the user on a tennis court. This back and forth movement from the court to the receptacle to dump the balls can be time consuming and inconvenient.

DETAILED DESCRIPTION

Implementations of a tennis ball pickup tube attachment bag are provided. In some implementations, the tennis ball pickup tube attachment bag comprises one or more pieces of material attached together and forming an enclosed interior and a corresponding exterior. In some implementations, the tennis ball pickup tube attachment bag also comprises a first opening and a second opening into the enclosed interior.

In some implementations, the tennis ball pickup tube attachment bag also comprises a first securing loop and a second securing loop. In some implementations, the tennis ball pickup tube attachment bag also comprises a first securing strap, a second securing strap, and a third securing strap.

In some implementations, the tennis ball pickup tube attachment bag is configured to connect to the top end of an existing tennis ball pickup tube.

In some implementations, the tennis ball pickup tube attachment bag is configured to receive and hold tennis balls that are picked up by a connected tennis ball pickup tube.

In some implementations, the tennis ball pickup tube attachment bag is configured to empty tennis balls that are collected and held in the tennis ball pickup tube attachment bag, for example into a receptacle or other container.

In some implementations, the tennis ball pickup tube attachment bag is configured to allow a user to collect many more tennis balls than can be collected by just using a tennis ball pickup tube alone.

In some implementations, the tennis ball pickup tube attachment bag is configured to allow a user to collect many more tennis balls than with just a tennis ball pickup tube before the tennis ball pickup tube attachment bag needs to be emptied to collect additional tennis balls.

In some implementations, the tennis ball pickup tube attachment bag thereby reduces the time consumption and increases the convenience to collect tennis balls from a tennis court and to empty the tennis balls into a receptacle.

In some implementations, a method for using the tennis ball pickup tube attachment bag comprises coupling the tennis ball pickup tube to the tennis ball pickup tube attachment bag. In some implementations, the method comprises attaching the first securing loop and the second securing loop respectively to the first retainer wing and the second retainer wing of the tennis ball pickup tube.

In some implementations, the method comprises attaching the first securing strap to the carry strap loop of the tennis ball pickup tube. In some implementations, the method comprises attaching the second securing strap and the third securing strap respectively across the length of the tennis ball pickup tube.

Figure 1:
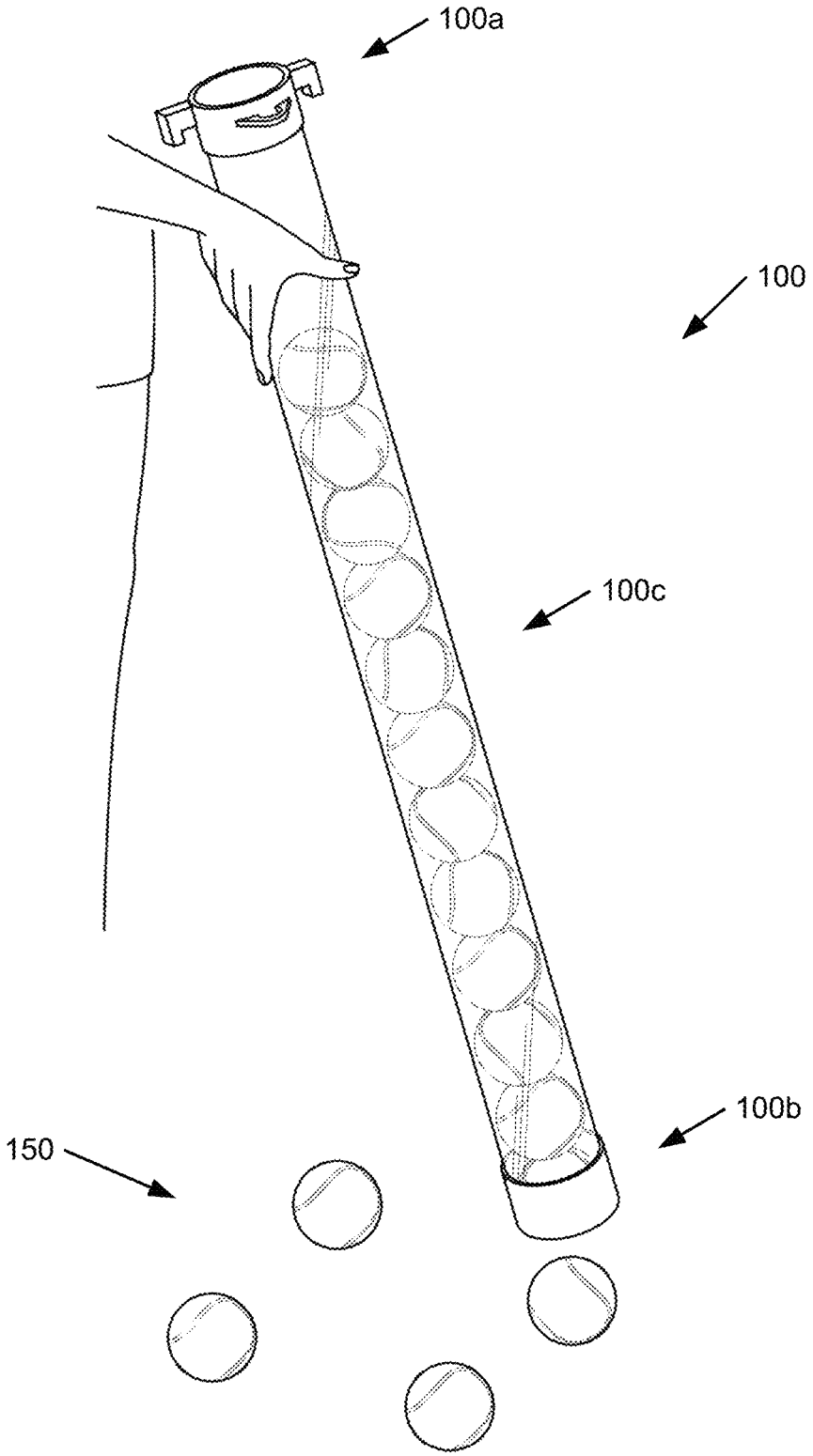
FIG. 1 (PRIOR ART)
FIG. 1 illustrates an example existing tennis ball pickup tube used to collect tennis balls on a tennis court.

FIG. 1 illustrates an example existing tennis ball pickup tube 100 used to collect tennis balls 150 on a tennis court. The tennis ball pickup tube 100 includes an elongated tube 100*c* that extends between a top end 100*a* and a bottom end 100*b*.

The tennis ball pickup tube 100 is configured to pick up tennis balls 150 at the bottom end 100*b*. The bottom end 100*b* and the top end 100*a* are configured to hold the picked up tennis balls 150 in the elongated tube 100*c*.

Figure 2:
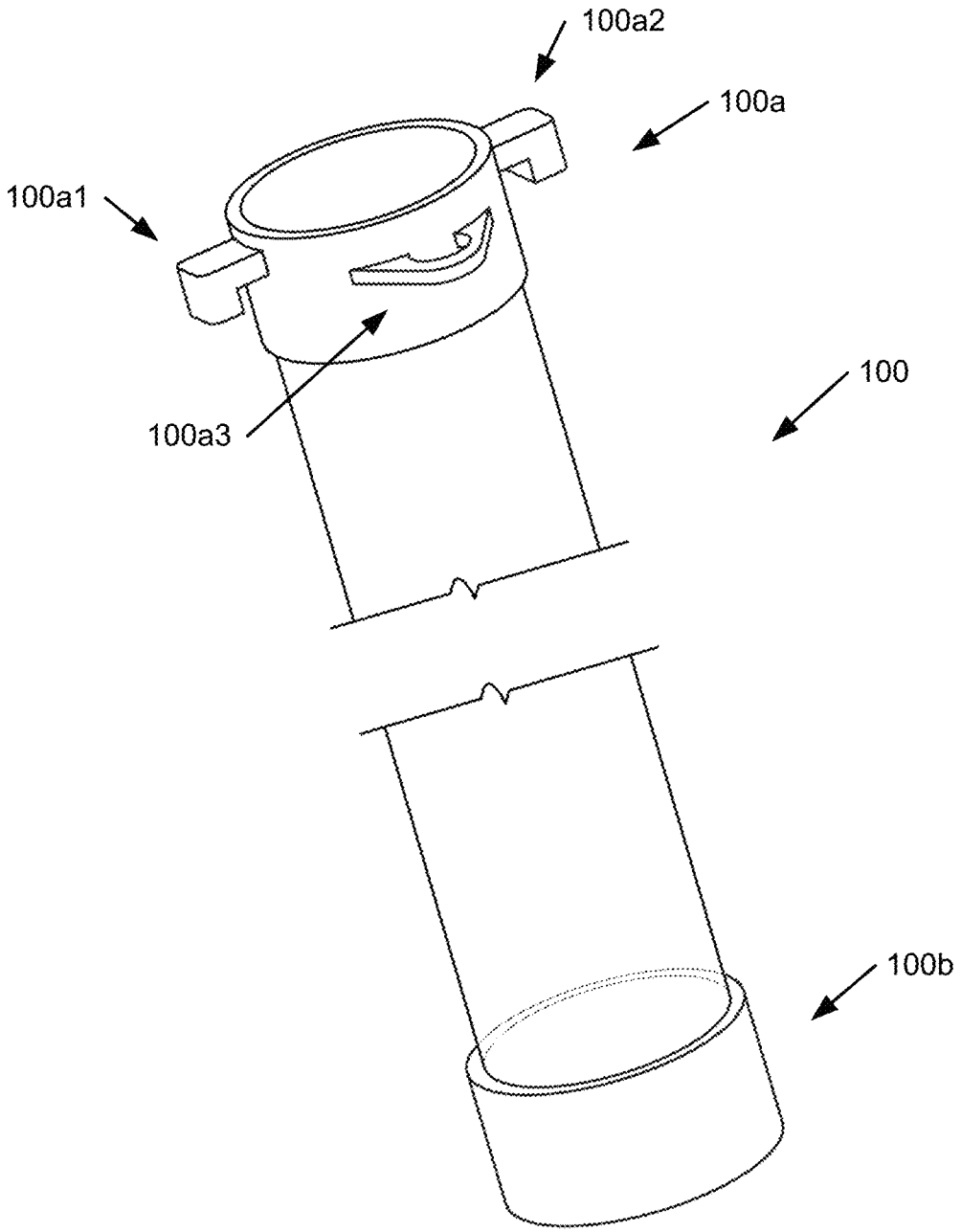
FIG. 2 (PRIOR ART)
FIG. 2 illustrates an example top end and bottom end of an existing tennis ball pickup tube.

FIG. 2 illustrates the top end 100*a* and the bottom end 100*b* of the existing tennis ball pickup tube 100. As shown in FIG. 2, the top end 100*a* includes a pair of retainer fingers or wings 100*a*1, 100*a*2 extending from opposite sides of the top end 100*a*. The tennis ball pickup tube 100 may include an elastic band or other retainer (not shown) that attaches to the retainer wings 100*a*1. The band or other retainer can be attached to the retainer wings 100*a*1, 100*a*2 to hold picked up tennis balls in the elongated tube 100*c* at the top end 100*a*. The band or other retainer can be removed from the retainer wings 100*a*1, 100*a*2 to allow picked up tennis balls to be emptied from the tennis ball pickup tube 100 at the top end 100*a*.

As shown in FIG. 2, the top end 100*a* of the tennis ball pickup tube 100 also includes a carry strap loop 100*a*3. The tennis ball pickup tube 100 may include a carry strap (not shown) that attaches to the carry strap loop 100*a*3.

As can be seen in FIG. 1, the tennis ball pickup tube 100 can only collect a limited number of tennis balls 150 and must be emptied repeatedly to collect additional balls 150. As discussed above, to empty the tennis ball pickup tube 100, a user must dump the tennis balls 150 into a receptacle which is usually some distance away from the current location of the user on a tennis court. As discussed above, this back and forth movement from the court to the receptacle to dump the balls 150 can be time consuming and inconvenient.

Figure 3:
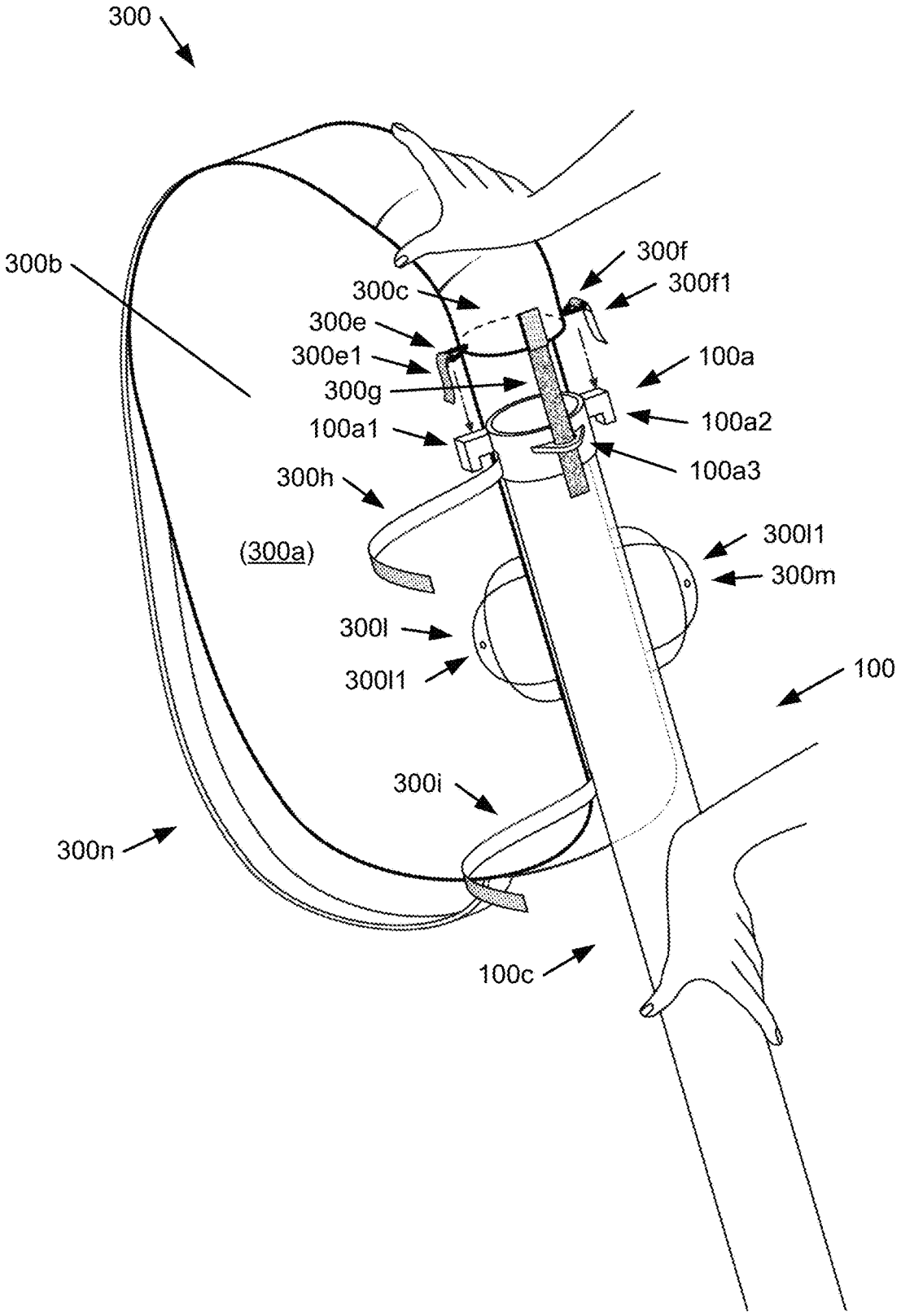
FIGS. 3-5 illustrate an implementation of an example tennis ball pickup tube attachment bag according to the present disclosure.
Figure 4:
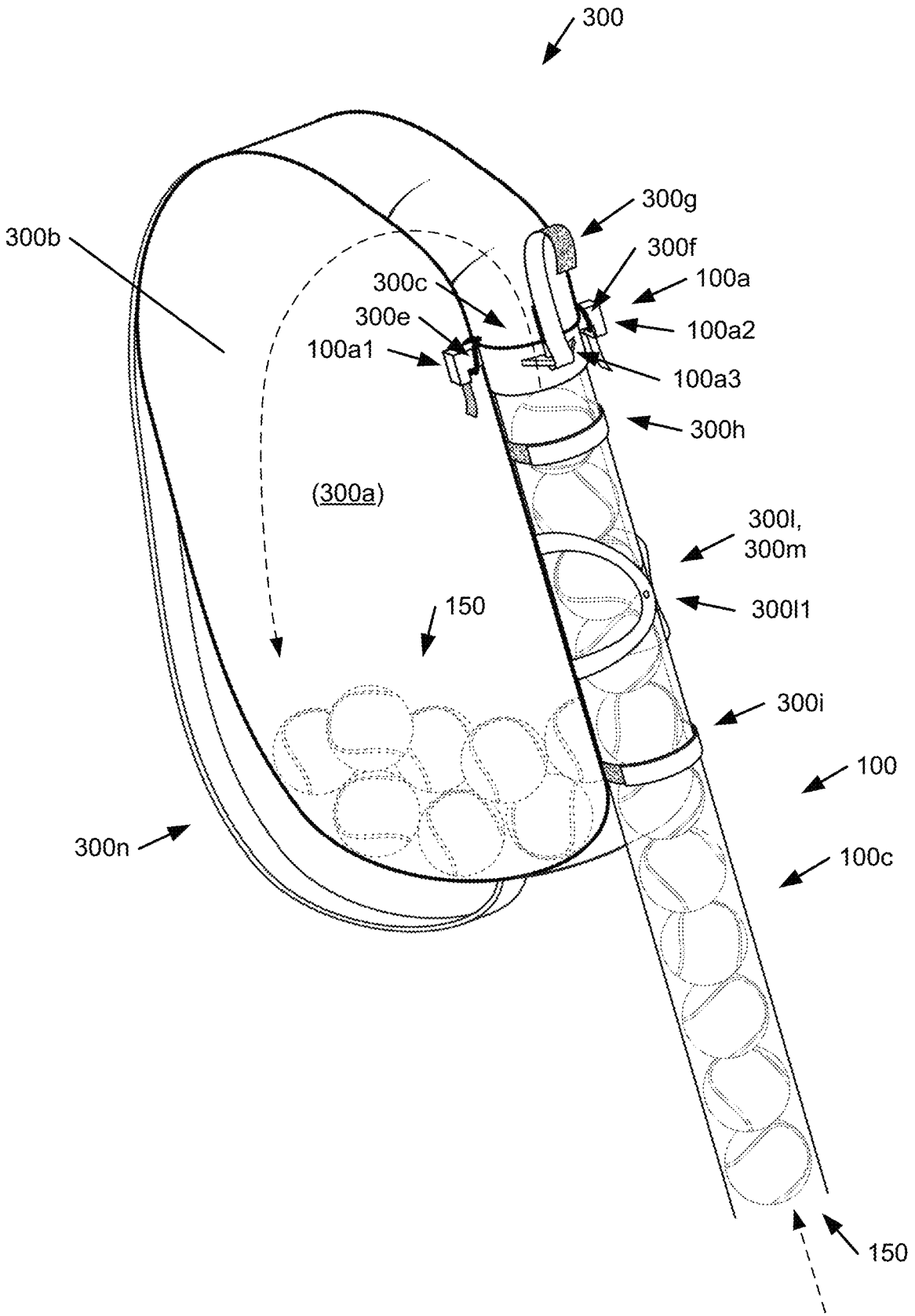
Figure 5:
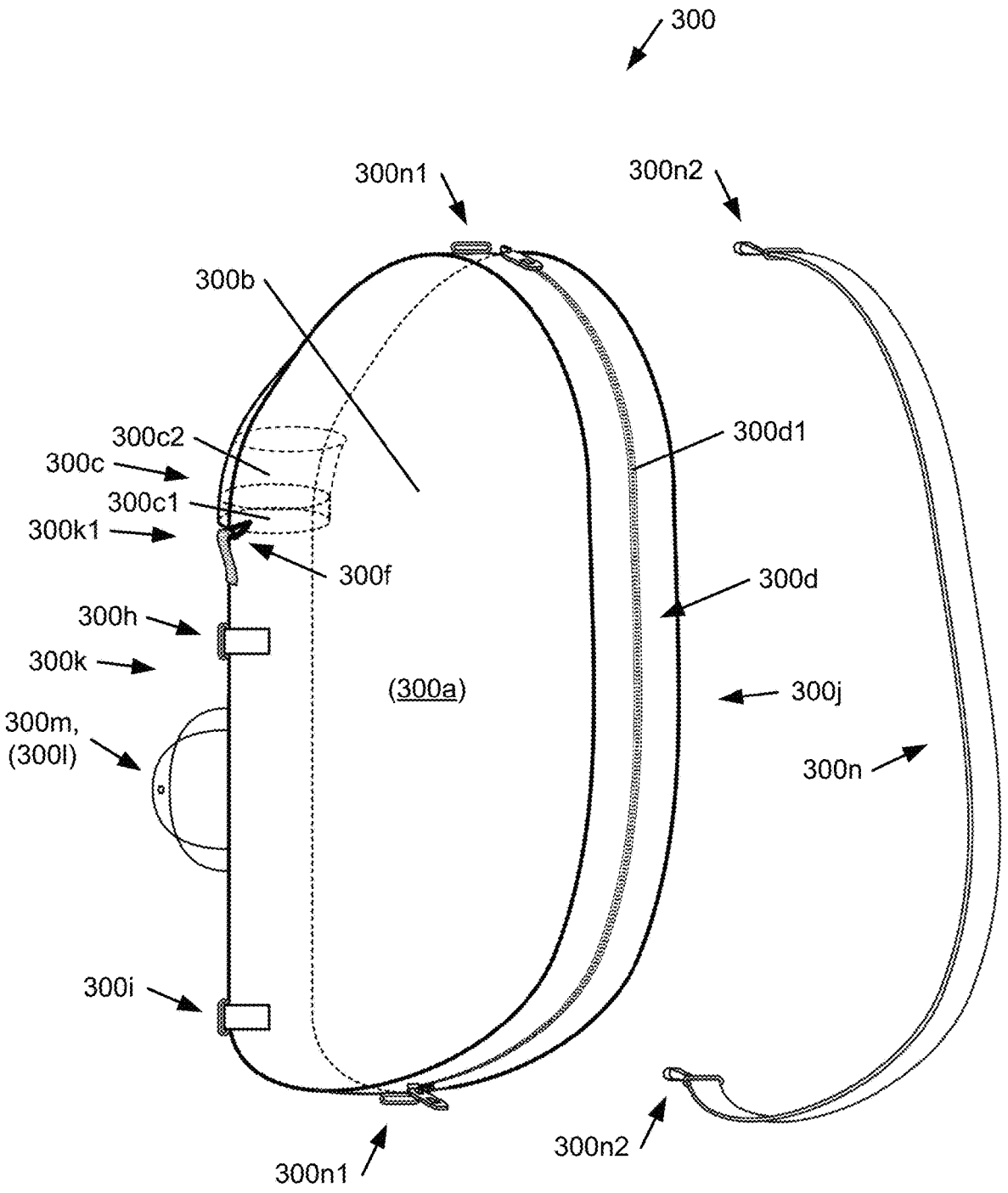

FIGS. 3-5 illustrate an implementation of an example tennis ball pickup tube attachment bag 300 according to the present disclosure. As shown in FIG. 3, in some implementations, the tennis ball pickup tube attachment bag 300 comprises one or more pieces of material attached together and forming an enclosed interior 300*a* and a corresponding exterior 300*b*. In some implementations, the tennis ball pickup tube attachment bag 300 also comprises a first opening 300*c* and a second opening 300*d* into the enclosed interior 300*a*.

In some implementations, the tennis ball pickup tube attachment bag 300 also comprises a first securing loop 300*e* and a second securing loop 300*f*. In some implementations, the tennis ball pickup tube attachment bag 300 also comprises a first securing strap 300*g*, a second securing strap 300*h*, and a third securing strap 300*i*.

In some implementations, the material attached together and forming the tennis ball pickup tube attachment bag 300 can be any suitable material. For example, in some implementations, the material attached together and forming the tennis ball pickup tube attachment bag 300 may be a thin, flexible, and/or durable material, such as a canvas or nylon based material.

As shown in FIG. 4, in some implementations, the enclosed interior 300*a* is configured to receive within and contain tennis balls 150. In some implementations, the enclosed interior 300*a* may be configured to receive within and contain other items in addition to tennis balls 150, such as a tennis racket or other tennis related items (not shown). In some implementations, the enclosed interior 300*a* may be configured to receive within and contain any other suitable items in addition to tennis balls 150.

As shown in FIG. 4, in some implementations, the first opening 300*c* is configured to receive tennis balls 150 through the first opening 300*c* into the enclosed interior 300*a*.

As shown in FIG. 3, in some implementations, the first opening 300*c* is configured to couple to a top end 100*a* of a tennis ball pickup tube 100.

As shown in FIG. 4, in some implementations, the first opening 300*c* is configured to couple to the top end 100*a* so that tennis balls 150 that are picked up through a bottom end 100*b* of the tennis ball pickup tube 100 are received from the top end 100*a* into the enclosed interior 300*a* through the first opening 300*c*.

As shown in FIG. 4, in some implementations, the first opening 300*c* is configured to couple to the top end 100*a* of the tennis ball pickup tube 100 so that the top end 100*a* of the tennis ball pickup tube 100 inserts partially into the first opening 300*c*. In some implementations, the first opening 300*c* is configured to couple to the top end 100*a* of the tennis ball pickup tube 100 in any other suitable configuration.

As shown in FIG. 5, in some implementations, the first opening 300*c* comprises a collar portion 300*c*1 at the end of the first opening 300*c*. In some implementations, the collar portion 300*c*1 is configured to snugly receive the top end 100*a* of the tennis ball pickup tube 100 partially through the collar portion 300*c*1 into the first opening 300*c* so that the tennis ball pickup tube 100 can be coupled to the first opening 300*c*.

As shown in FIG. 5, in some implementations, the first opening 300*c* comprises a chute portion 300*c*2 that extends to the enclosed interior 300*a*. For example, in some implementations, the chute portion 300*c*2 extends from the collar portion 300*c*1 to the enclosed interior 300*a*.

In some implementations, the chute portion 300*c*2 is configured to allow tennis balls 150 to flow unobstructed through the first opening 300*c* from the top end 100*a* of the tennis ball pickup tube 100 into the enclosed interior 300*a* when the top end 100*a* is coupled to the first opening 300*c*.

For example, in some implementations, the chute portion 300*c*2 may comprise stitching configured to maintain and/or reinforce the shape of the chute portion 300*c*2 to allow the unobstructed flow of tennis balls 150 through the first opening 300*c*. In some implementations, the chute portion 300*c*2 may comprise thicker and/or stiffer material configured to maintain and/or reinforce the shape of the chute portion 300*c*2 to allow the unobstructed flow of tennis balls 150 through the first opening 300*c*.

As shown in FIG. 5, in some implementations, the second opening 300*d* includes a closure 300*d*1. In some implementations, the closure 300*d*1 of the second opening 300*d* is a zipper closure. In some implementations, the closure 300*d*1 may be any other suitable closure.

In some implementations, the second opening 300*d* is configured to be closed by the closure 300*d*1 so that tennis balls 150 that are received into the enclosed interior 300*a* are held in the enclosed interior 300*a* when the second opening 300*d* is closed by the closure 300*d*1.

In some implementations, the second opening 300*d* is configured to be opened by the closure 300*d*1 so that the tennis balls 150 can be emptied from the enclosed interior 300*a* when the second opening 300*d* is opened by the closure 300*d*1.

As shown in FIG. 5, in some implementations, the tennis ball pickup tube attachment bag 300 is rectangular prism shaped. In some implementations, the tennis ball pickup tube attachment bag 300 may have any other suitable shape.

In some implementations, in which the tennis ball pickup tube attachment bag 300 is rectangular prism shaped, the second opening 300*d* extends lengthwise along a first side 300*j* of the tennis ball pickup tube attachment bag 300. In some implementations, the first side 300*j* extends lengthwise and depth-wise with respect to the tennis ball pickup tube attachment bag 300.

In some implementations, the first opening 300*c* is formed at one end 300*k*1 of a second side 300*k* of the tennis ball pickup tube attachment bag 300 that is opposite to the first side 300*j*. In some implementations, the first opening 300*c* is so formed so that the tennis ball pickup tube 100 extends parallel and adjacent to the second side 300*k* when the tennis ball pickup tube 100 is coupled to the first opening 300*c*.

As shown in FIG. 3, in some implementations, the first securing loop 300*e* is attached to and extends from the exterior 300*b* adjacent to the first opening 300*c*.

As shown in FIG. 4, in some implementations, the first securing loop 300*e* is configured to attach to a first retainer wing 100*a*1 on the top end 100*a* of the tennis ball pickup tube 100 so that the first securing loop 300*e* secures the top end 100*a* toward the first opening 300*c* when the top end 100*a* is coupled to the first opening 300*c*.

As shown in FIG. 3, in some implementations, the second securing loop 300*f* is attached to and extends from the exterior 300*b* adjacent to the first opening 300*c*.

As shown in FIG. 4, in some implementations, the second securing loop 300*f* is configured to attach to a second retainer wing 100*a*2 on the top end 100*a* of the tennis ball pickup tube 100 so that the second securing loop 300*f* secures the top end 100*a* toward the first opening 300*c* when the top end 100*a* is coupled to the first opening 300*c*.

In some implementations, the first securing loop 300*e* and the second securing loop 300*f* are each an elastic loop. In some implementations, the securing loops 300*e*, 300*f* may each be any other suitable type of loop.

As shown in FIG. 3, in some implementations, each securing loop 300*e*, 300*f* may respectively include a pull-strap 300*e*1, 300*f*1. In some implementations, the pull-strap 300*e*1, 300*f*1 is attached to and extends from the respective securing loop 300*e*, 300*f*.

In some implementations, the pull-strap 300*e*1, 300*f*1 is configured to assist a user to pull the respective securing loop 300*e*, 300*f*. In some implementations, the pull-strap 300*e*1, 300*f*1 is configured to thereby assist the user to attach the respective securing loop 300*e*, 300*f* to the respective retainer wing 100*a*1, 100*a*2 of the tennis ball pickup tube 100 as described herein.

As shown in FIG. 3, in some implementations, the first securing strap 300*g* is attached to and extends from the exterior 300*b* adjacent to the first opening 300*c*.

As shown in FIG. 4, in some implementations, the first securing strap 300*g* is configured to attach to a carry strap loop 100*a*3 on the top end 100*a* of the tennis ball pickup tube 100 so that the first securing strap 300*g* secures the top end 100*a* toward the first opening 300*c* when the top end 100*a* is coupled to the first opening 300*c*.

As shown in FIG. 3, in some implementations, the second securing strap 300*h* is attached to and extends from the exterior 300*b* adjacent to the first opening 300*c*.

As shown in FIG. 4, in some implementations, the second securing strap 300*h* is configured to attach across the length of the tennis ball pickup tube 100 and secure the tennis ball pickup tube 100 adjacent to the tennis ball pickup tube attachment bag 300 when the top end 100*a* is coupled to the first opening 300*c*.

As shown in FIG. 3, in some implementations, the third securing strap 300*i* is attached to and extends from the exterior 300*b* distanced from the first opening 300*c*.

As shown in FIG. 4, in some implementations, the third securing strap 300*i* is configured to attach across the length of the tennis ball pickup tube 100 and secure the tennis ball pickup tube 100 adjacent to the tennis ball pickup tube attachment bag 300 when the top end 100*a* is coupled to the first opening 300*c*.

In some implementations, the first securing strap 300*g*, the second securing strap 300*h*, and the third securing strap 300*i* are each a hook and loop (e.g., Velcro®) secured strap. In some implementations, the first securing strap 300*g*, the second securing strap 300*h*, and the third securing strap 300*i* may each be a friction-buckle secured strap.

In some implementations, the first securing strap 300*g*, the second securing strap 300*h*, and the third securing strap 300*i* may each be any other suitable type of strap.

As shown in FIG. 4, in some implementations, the tennis ball pickup tube attachment bag 300 further comprises the tennis ball pickup tube 100 coupled to the first opening 300*c* of the tennis ball pickup tube attachment bag 300. In some implementations, the tennis ball pickup tube 100 coupled to the first opening 300*c* with the first securing loop 300*e* and the second securing loop 300*f* attached respectively to the first retainer wing 100*a*1 and the second retainer wing 100*a*2 thereby securing the top end 100*a* of the tennis ball pickup tube 100 toward the first opening 300*c*.

In some implementations, the tennis ball pickup tube 100 is coupled to the first opening 300*c* with the first securing strap 300*g* attached to the carry strap loop 100*a*3 thereby also securing the top end 100*a* of the tennis ball pickup tube 100 toward the first opening 300*c*.

In some implementations, the tennis ball pickup tube 100 is coupled to the first opening 300*c* with the second securing strap 300*h* and the third securing strap 300*i* attached respectively across the length of the tennis ball pickup tube 100 thereby securing the tennis ball pickup tube 100 adjacent to the tennis ball pickup tube attachment bag 300.

As shown in FIG. 3, in some implementations, the tennis ball pickup tube attachment bag 300 further comprises a first handle strap 300*l* and a second handle strap 300*m* attached to the exterior 300*b* of the tennis ball pickup tube attachment bag 300. In some implementations, the handle straps 300*l*, 300*m* are attached to the exterior 300*b* between the second securing strap 300*h* and the third securing strap 300*i*.

As shown in FIG. 4, in some implementations, the handle straps 300*l*, 300*m* are configured to connect together across the length of the tennis ball pickup tube 100. For example, in some implementations, the handle straps 300*l*, 300*m* may connect together across the length of the tennis ball pickup tube 100 by a closure 300*l*1 such as a snap closure.

In some implementations, the handle straps 300*l*, 300*m* may connect together across the length of the tennis ball pickup tube 100 to further secure the tennis ball pickup tube 100 adjacent to the tennis ball pickup tube attachment bag 300 when the top end 100*a* is coupled to the first opening 300*c*.

In some implementations, the handle straps 300*l*, 300*m* are also configured to allow a user to carry the tennis ball pickup tube attachment bag 300 by the handle straps 300*l*, 300*m*.

As shown in FIG. 5, in some implementations, the tennis ball pickup tube attachment bag 300 further comprises carry strap connectors 300*n*1 attached to the exterior 300*b* of the tennis ball pickup tube attachment bag 300. In some implementations, the carry strap connectors 300*n*1 may be rings, snap hooks, or any other suitable connectors.

In some implementations, the tennis ball pickup tube attachment bag 300 also further comprises a carry strap 300*n*. In some implementations, the carry strap 300*n* is configured to attach to the carry strap connectors 300*n*1. For example, in some implementations, the carry strap 300*n* includes rings, snap hooks, or any other suitable connectors 300*n*2 on each end that can connect to the carry strap connectors 300*n*1.

In some implementations, the carry strap 300*n* is configured to allow a user to carry the tennis ball pickup tube attachment bag 300 by the carry strap 300*n* when attached to the tennis ball pickup tube attachment bag 300 by the carry strap connectors 300*n*1, 300*n*2.

In some implementations, the carry strap 300*n* may be a shoulder strap. In some implementations, the carry strap 300*n* may be any other suitable strap that allows a user to carry the tennis ball pickup tube attachment bag 300.

In some implementations, the tennis ball pickup tube attachment bag 300 is configured to connect to the top end 100*a* of an existing tennis ball pickup tube 100.

In some implementations, the tennis ball pickup tube attachment bag 300 is configured to receive and hold tennis balls 150 that are picked up by a connected tennis ball pickup tube 100.

In some implementations, the tennis ball pickup tube attachment bag 300 is configured to empty tennis balls 150 that are collected and held in the tennis ball pickup tube attachment bag 300, for example into a receptacle or other container.

In some implementations, the tennis ball pickup tube attachment bag 300 is configured to allow a user to collect many more tennis balls 150 than can be collected by just using a tennis ball pickup tube 100 alone.

In some implementations, the tennis ball pickup tube attachment bag 300 is configured to allow a user to collect many more tennis balls 150 than with just a tennis ball pickup tube 100 before the tennis ball pickup tube attachment bag 300 needs to be emptied to collect additional tennis balls 150.

In some implementations, the tennis ball pickup tube attachment bag 300 thereby reduces the time consumption and increases the convenience to collect tennis balls 150 from a tennis court and to empty the tennis balls 150 into a receptacle.

In some implementations, the tennis ball pickup tube attachment bag 300 comprises any suitable dimensions.

In some implementations, the tennis ball pickup tube attachment bag 300 can be composed of any suitable materials, such as the example materials described above.

In some implementations, the tennis ball pickup tube attachment bag 300 can have any suitable appearance.

As shown by FIG. 3, in some implementations, a method of using the tennis ball pickup tube attachment bag 300 comprises coupling the top end 100*a* of the tennis ball pickup tube 100 to the first opening 300*c* of the tennis ball pickup tube attachment bag 300.

As shown by FIG. 4, in some implementations, coupling the top end 100*a* of the tennis ball pickup tube 100 to the first opening 300*c* comprises partially inserting the top end 100*a* of the tennis ball pickup tube 100 into the first opening 300*c*.

In some implementations, the method comprises attaching the first securing loop 300*e* and the second securing loop 300*f* respectively to the first retainer wing 100*a*1 and the second retainer wing 100*a*2, thereby securing the top end 100*a* of the tennis ball pickup tube 100 toward the first opening 300*c*.

In some implementations, the method comprises attaching the first securing strap 300*e* attached to the carry strap loop 100*a*3, thereby also securing the top end 100*a* of the tennis ball pickup tube 100 toward the first opening 300*c*.

In some implementations, the method comprises attaching the second securing strap 300*f* and the third securing strap 300*i* respectively across the length of the tennis ball pickup tube 100, thereby securing the tennis ball pickup tube 100 adjacent to the tennis ball pickup tube attachment bag 300.

As shown by FIG. 4, in some implementations, the method of using the tennis ball pickup tube attachment bag 300 further comprises picking up the tennis balls 150 with the tennis ball pickup tube 100 while coupled and secured to the tennis ball pickup tube attachment bag 300. In some implementations, picking up the tennis balls 150 comprises receiving the tennis balls 150 into the elongated tube 100*c* through the bottom end 100*b*.

In some implementations, picking up the tennis balls 150 comprises receiving the tennis balls 150 from the elongated tube 100*c* through the top end 100*a* into the enclosed interior 300*a* through the first opening 300*c*.

In some implementations, the method of using the tennis ball pickup tube attachment bag 300 further comprises emptying the tennis balls 150 from the enclosed interior 300*a* through the second opening 300*c*.

In some implementations, the method of using the tennis ball pickup tube attachment bag 300 further comprises carry the tennis ball pickup tube attachment bag 300 by a carry strap 300*n* attached to the tennis ball pickup tube attachment bag 300 by the carry strap connectors 300*n*1, 300*n*2.

The figures, including photographs and drawings, comprised herewith may represent one or more implementations of the tennis ball pickup tube attachment bag.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A tennis ball pickup tube attachment bag, comprising:

one or more pieces of material attached together and forming an enclosed interior and a corresponding exterior, wherein the enclosed interior is configured to receive within and contain tennis balls;

a first opening into the enclosed interior, wherein the first opening is configured to receive the tennis balls through the first opening into the enclosed interior, and to couple to a top end of a tennis ball pickup tube so that the tennis balls that are picked up through a bottom end of the tennis ball pickup tube are received from the top end of the tennis ball pickup tube into the enclosed interior through the first opening;

a second opening into the enclosed interior that includes a closure, wherein the second opening is configured to be closed and opened by the closure so that the tennis balls that are received into the enclosed interior are held in the enclosed interior when the second opening is closed by the closure and the tennis balls can be emptied from the enclosed interior when the second opening is opened by the closure;

a first securing loop attached to and extending from the exterior adjacent to the first opening and configured to attach to a first retainer wing on the top end of the tennis ball pickup tube so that the first securing loop secures the top end of the tennis ball pickup tube toward the first opening when the top end is coupled to the first opening;

a second securing loop attached to and extending from the exterior adjacent to the first opening and configured to attach to a second retainer wing on the top end of the tennis ball pickup tube so that the second securing loop secures the top end of the tennis ball pickup tube toward the first opening when the top end is coupled to the first opening;

a first securing strap attached to and extending from the exterior adjacent to the first opening and configured to attach to a carry strap loop on the top end of the tennis ball pickup tube so that the first securing strap secures the top end of the tennis ball pickup tube toward the first opening when the top end is coupled to the first opening;

a second securing strap attached to and extending from the exterior adjacent to the first opening and configured to attach across the length of the tennis ball pickup tube and secure the tennis ball pickup tube adjacent to the tennis ball pickup tube attachment bag when the top end is coupled to the first opening; and a third securing strap attached to and extending from the exterior distanced from the first opening and configured to attach across the length of the tennis ball pickup tube and secure the tennis ball pickup tube adjacent to the tennis ball pickup tube attachment bag when the top end is coupled to the first opening;

wherein the tennis ball pickup tube comprises an elongated tube extending between the top end and the bottom end of the tennis ball pickup tube and configured to receive the tennis balls into the elongated tube through the bottom end and to empty the tennis balls from the elongated tube through the top end.

2. The tennis ball pickup tube attachment bag of claim 1, further comprising the tennis ball pickup tube coupled to the first opening of the tennis ball pickup tube attachment bag with the first securing loop and the second securing loop attached respectively to the first retainer wing and the second retainer wing thereby securing the top end of the tennis ball pickup tube toward the first opening, the first securing strap attached to the carry strap loop thereby also securing the top end of the tennis ball pickup tube toward the first opening, and the second securing strap and the third securing strap attached respectively across the length of the tennis ball pickup tube thereby securing the tennis ball pickup tube adjacent to the tennis ball pickup tube attachment bag.

3. The tennis ball pickup tube attachment bag of claim 1, wherein the first opening is configured to couple to the top end of the tennis ball pickup tube so that the top end of the tennis ball pickup tube inserts partially into the first opening.

4. The tennis ball pickup tube attachment bag of claim 1, wherein the first opening comprises a collar portion at the end of the first opening, wherein the collar portion is configured to snugly receive the top end of the tennis ball pickup tube partially through the collar portion into the first opening so that the tennis ball pickup tube can be coupled to the first opening.

5. The tennis ball pickup tube attachment bag of claim 1, wherein the first opening comprises a chute portion that extends to the enclosed interior, wherein the chute portion is configured to allow the tennis balls to flow unobstructed through the first opening from the top end of the tennis ball pickup tube into the enclosed interior when the top end is coupled to the first opening.

6. The tennis ball pickup tube attachment bag of claim 1, wherein:

the tennis ball pickup tube attachment bag is rectangular prism shaped;

the second opening extends lengthwise along a first side of the tennis ball pickup tube attachment bag, wherein the first side extends lengthwise and depth-wise with respect to the tennis ball pickup tube attachment bag; and the first opening is formed at one end of a second side of the tennis ball pickup tube attachment bag that is opposite to the first side, so that the tennis ball pickup tube extends parallel and adjacent to the second side when the tennis ball pickup tube is coupled to the first opening.

7. The tennis ball pickup tube attachment bag of claim 1, wherein the first securing loop and the second securing loop are each an elastic loop.

8. The tennis ball pickup tube attachment bag of claim 1, wherein the first securing strap, the second securing strap, and the third securing strap are each a hook and loop secured strap.

9. The tennis ball pickup tube attachment bag of claim 1, further comprising a first handle strap and a second handle strap attached to the exterior of the tennis ball pickup tube attachment bag between the second securing strap and the third securing strap and configured to connect together across the length of the tennis ball pickup tube and to allow a user to carry the tennis ball pickup tube attachment bag by the first handle strap and the second handle strap.

10. The tennis ball pickup tube attachment bag of claim 1, further comprising:

carry strap connectors attached to the exterior of the tennis ball pickup tube attachment bag; and a carry strap configured to attach to the carry strap connectors and to allow a user to carry the tennis ball pickup tube attachment bag by the carry strap when attached to the carry strap connectors.

11. The tennis ball pickup tube attachment bag of claim 1, wherein the closure of the second opening is a zipper closure.

12. A method of using the tennis ball pickup tube attachment bag of claim 1, comprising:

coupling the top end of the tennis ball pickup tube to the first opening of the tennis ball pickup tube attachment bag;

attaching the first securing loop and the second securing loop respectively to the first retainer wing and the second retainer wing thereby securing the top end of the tennis ball pickup tube toward the first opening;

attaching the first securing strap attached to the carry strap loop thereby also securing the top end of the tennis ball pickup tube toward the first opening; and attaching the second securing strap and the third securing strap respectively across the length of the tennis ball pickup tube thereby securing the tennis ball pickup tube adjacent to the tennis ball pickup tube attachment bag.

13. The method of claim 12, wherein coupling the top end of the tennis ball pickup tube to the first opening comprises partially inserting the top end of the tennis ball pickup tube into the first opening.

14. The method of claim 12, further comprising picking up the tennis balls with the tennis ball pickup tube while coupled and secured to the tennis ball pickup tube attachment bag by receiving the tennis balls into the elongated tube through the bottom end, and receiving the tennis balls from the elongated tube through the top end into the enclosed interior through the first opening.

15. The method of claim 14, further comprising emptying the tennis balls from the enclosed interior through the second opening.

* * * * *